US005306356A

United States Patent [19]

Brissonneau et al.

[11] Patent Number: 5,306,356

[45] Date of Patent: Apr. 26, 1994

[54] MAGNETIC SHEET METAL OBTAINED FROM HOT-ROLLED STRIP STEEL CONTAINING, IN PARTICULAR, IRON, SILICON AND ALUMINUM

[75] Inventors: Pierre Brissonneau, Grenoble; Jacques Quenin, Gieres; Jean Verdun, St Chély d'Apcher, all of France

[73] Assignee: Ugine, Aciers de Chatillon et Gueugnon, Puteaux, France

[21] Appl. No.: 807,627

[22] Filed: Dec. 13, 1991

Related U.S. Application Data

[63] Continuation of Ser. No. 530,587, May 31, 1990, abandoned.

[30] Foreign Application Priority Data

Jun. 1, 1989 [FR] France ..... 89 07263

[51] Int. Cl.[5] ..... C22C 38/02; C22C 38/06; H01F 1/147

[52] U.S. Cl. ..... 148/308; 148/309; 420/103

[58] Field of Search ..... 148/308, 309, 311; 420/77, 78, 103

[56] References Cited

U.S. PATENT DOCUMENTS

| | | | |
|---|---|---|---|
| 3,008,856 | 11/1961 | Mobius | 198/111 |
| 3,971,678 | 7/1976 | Vlad | 148/308 |
| 4,437,910 | 3/1984 | Nozawa et al. | 148/111 |
| 4,762,575 | 8/1988 | Sakakura et al. | 148/111 |

*Primary Examiner*—George Wyszomierski
*Attorney, Agent, or Firm*—Cushman, Darby & Cushman

[57] ABSTRACT

Magnetic sheet metal obtained from hot-rolled strip steel containing, in particular, iron, silicon and aluminium and forming part of a family of sheet metals having orientated grains, characterized in that its composition is as follows: silicon less than 3.3%, aluminium between 1.5 and 8%, in concentration by weight, and in that the strip steel is subjected to cold-rolling in two steps with a final degree of reduction of between 50 and 80%, the magnetic sheet metal obtained having a general structure of the cubic type, at least 40% of the grains not deviating by more than 15° from the ideal cubic orientation (100), 001 in the Miller notation.

8 Claims, 2 Drawing Sheets

FIG. 2
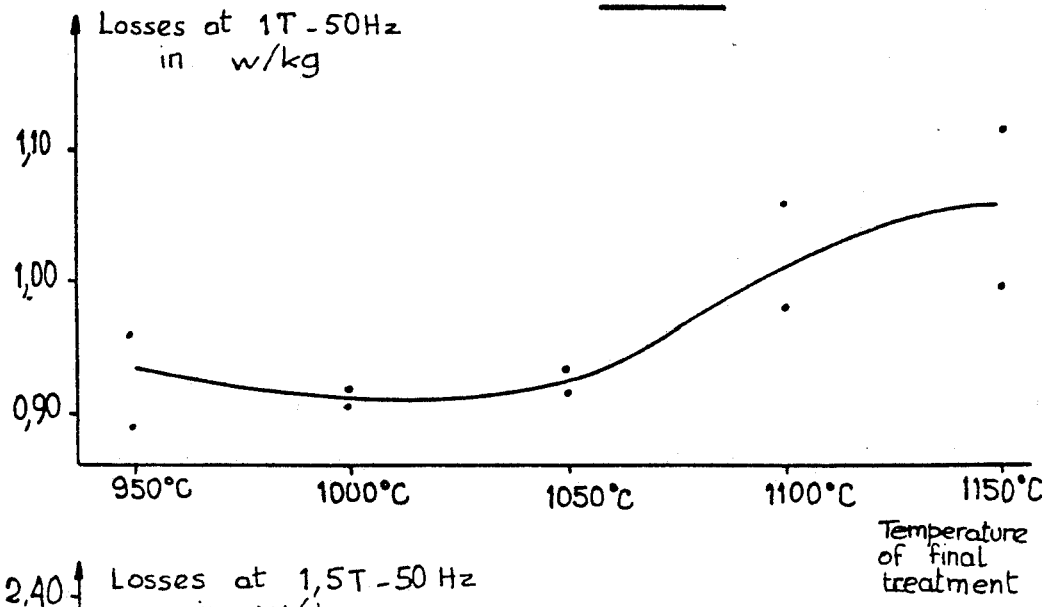
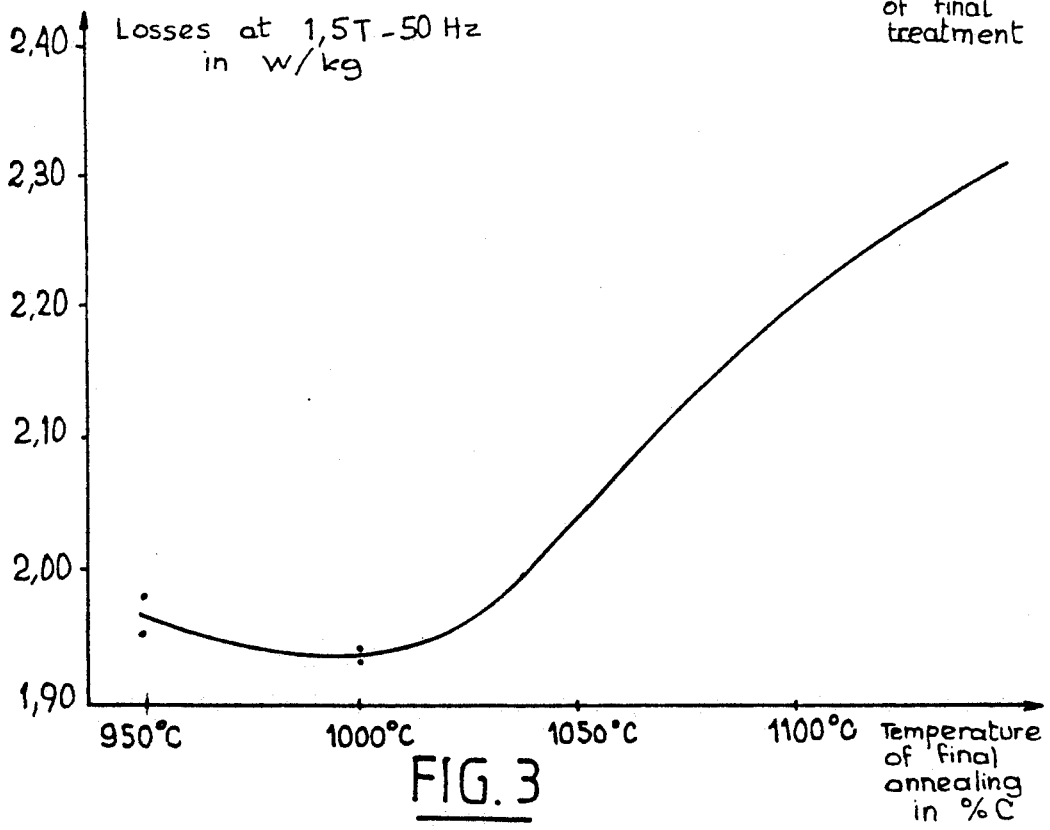
FIG. 3

MAGNETIC SHEET METAL OBTAINED FROM HOT-ROLLED STRIP STEEL CONTAINING, IN PARTICULAR, IRON, SILICON AND ALUMINUM

This is a continuation of application Ser. No. 07/530,587, filed on May 31, 1990, which was abandoned upon the filing hereof.

The present invention relates to a sheet metal containing, in particular iron, silicon and aluminium and forming part of a family of sheet metals having orientated grains having a structure of the cubic type, that is to say a sheet metal possessing two directions of easy magnetization, one identical to the direction of rolling and the other perpendicular to the direction of rolling, in the plane of the sheet metal, termed transverse direction.

It is known that the magnetic sheet metals termed non-oriented are intended more particularly for the construction of circuits fed with alternating current, and in particular those of rotary machines of high power. For the construction of these machines, it is important to have available high performance magnetic circuits.

The stator consists of assembled metal sheets and the latter have a degree of efficiency which is estimated as a function of two parameters, which are the induction level on the one hand and the volume losses on the other hand.

The induction is limited by the magnetization at saturation of the material, and the losses comprise the hysteresis losses and Foucault current losses. Moreover, it is necessary to find a compromise between the materials having strong magnetization at saturation and having low losses.

Currently, the non-orientated sheet steels containing silicon give the best results because the particularly strong magnetization of the iron is only slightly reduced by the addition of alloying elements, passing from 2.16 tesla for pure iron to 2.0 tesla for the alloy containing 3.2% of silicon.

The increase in the electrical resistivity due to silicon enables the losses to be reduced.

Apart from the nature and the composition of the material, another important parameter for study is the structure. In fact, still regarding the rotary machines, the assemblies of metal sheets of the stator are divided into sectors, the volume of which breaks down into three essential regions:

- the teeth, in which the induction is orientated in accordance with a radial direction,
- the back of the stator, in which the induction is orientated in accordance with a tangential direction, and
- the median region, in which the induction runs in the plane of the sheet metals.

The known sheet metals having a GOSS (110) [001] structure or having orientated grains, or O.G., are not very suitable for a use of this type since they have a pronounced anisotropy and, although the GOSS structure leads to a very considerable improvement in the magnetic properties in the direction of rolling, its advantage disappears very rapidly as soon as the induction deviates from the direction of rolling. Poor magnetic properties must be understood as meaning not only the high specific magnetic losses but also the fact that it is necessary to apply an excitation field of high amplitude to approach the magnetization at saturation in a direction other than the direction of rolling, which can lead to heating of the coils by the Joule effect, which is prejudicial to the lifetime of the machine.

It is for this reason that, except in exceptional cases, sheet metals of GOSS structure are not used by constructors of rotary machines, who prefer to them the sheet metals termed non-orientated, in principle without structure, or with a not very pronounced rolling structure.

The sheet metals having non-orientated grains, termed N.O., have a low anisotropy in the plane of rolling because the grains are essentially distributed in a random manner, which gives rise to a statistically isotropic behaviour. However, the ternary alloy consisting of iron, silicon and aluminium, for example, has a significant magneto-crystalline anisotropic energy which tends to keep the atomic magnetic moments in the interior of each grain parallel to the quaternary axes of the crystal. The result is a distribution in orientated domains in accordance with the directions of easy magnetization of the type [100].

However, the easiest mechanisms of magnetization cause displacements in the walls, termed BLOCH walls, between adjacent domains. It is therefore advantageous, in the N.O. sheet metals, preferentially to orientate these domains in the direction of circulation of the flux.

The non-orientated sheet steels containing silicon are generally classified according to their specific losses $W_{15/50}$ (losses for a peak induction B=1.5 tesla at 50 hertz expressed in watts per kilogram) and their magnetic induction $B_{5000}$ in tesla (magnetic induction induced in an excitation field of 5000 A/m). The highest quality sheet steel listed in JIS (Japanese industrial standard) C2552 (1986) is the 35.A.230 grade (thickness 0.35 mm, $W_{15/50} \leqq 2.30$ W/kg and $B_{5000} \geqq 1.60$ T).

French patent FR-A-2 316 338 discloses a process for the production of sheet steels containing silicon, of the non-orientated grain type, with low losses and a high magnetic induction.

This process is applicable to sheet steels containing silicon which are hot-rolled and contain at most 0.020% of carbon, 2.5 to 3.5% of silicon, 0.1 to 1.0% of manganese and 0.3 to 1.5% of aluminium, the remainder consisting of iron and accidential impurities. After cold-rolling in at least two steps, with an intermediate annealing and a final annealing carried out continuously to obtain the final thickness, the process provides for sulphur and oxygen contents which are limited, respectively, to at most 0.0025% and 0.005% and for the final cold-rolling giving a degree of reduction of between 40 and 70%. The percentages given are expressed in concentrations by weight.

The following results are obtained with a composition of this type:

- losses in the iron $W_{15/50}$, that is to say in watts/kilogram at 50 Hz for B=1.5 tesla, of essentially 2.3 W/kg for a thickness of 0.35 mm.
- magnetic induction $B_{5000}$ (that is to say the magnetic induction in a field of 5000 A/m) of 1.70 tesla for a thickness of 0.35 mm.
- relative elongation at break measured in the longitudinal direction: 26%.
- relative elongation at break measured in the transverse direction: 29%.

These favourable characteristics are obtained after an intermediate annealing at a temperature not exceeding 950° C. carried out in an atmosphere of dry hydrogen, followed by a decarbonization at 825° C. and a final annealing at 1050° C., also in an atmosphere of dry hydrogen.

A comparative test was carried out with a sample having the same composition, with an identical decarbonization and final annealing but with an intermediate annealing temperature of 1050° C.

The losses in iron $W_{15/50}$ and the magnetic induction $B_{5000}$ obtained are essentially the same, but in this case the relative elongation at break measured in the direction of rolling is 3% and the relative elongation at break measured in the transverse direction is 10%.

These results show that with a sheet steel having the composition given in FR-A-2,316,338 and with an intermediate annealing at a temperature higher than 950° C., the sheet metal becomes too fragile and the rolling to the final thickness becomes impossible.

It should be noted that all of the examples of FR-A-2,316,338 are described with a proportion of silicon of between 2.5% and 3.5% and a proportion of aluminium not exceeding 1.5%, the steel becoming too fragile in the case where the percentage of aluminium exceeds this value.

It is therefore evident from this patent that the addition of aluminium in an increasing amount causes the alloy to become fragile to an increasingly marked degree.

The aim of the present invention is, therefore, to avoid these disadvantages while increasing the percentage of aluminium and reducing the percentage of silicon contrary to FR-A-2,316,338 and to propose a magnetic sheet metal containing, in particular, iron, silicon and aluminium and possessing a structure termed cubic, that is to say possessing two directions of easy magnetization in the plane of the sheet metal, one being identical to the direction of rolling and the other to the transverse direction, and the magnetic properties of which, in particular the permeability in fields of excitation of high amplitude and the specific losses at industrial frequency for a peak value of the induction of 1.5 tesla or more, are improved relative to the existing non-orientated iron/-silicon sheets, the whole with mechanical properties comparable to those of currently used non-orientated iron/silicon sheets.

According to the invention, the magnetic sheet metal is obtained from hot-rolled strip steel containing, in particular, iron, silicon and aluminium, characterized in that its composition by weight is as follows:

silicon less than 3.3%
aluminium between 1.5 and 8%
manganese less than 0.2%
sum of metal residues (nickel, chromium, molybdenum, titanium and copper) less than 0.1%
Carbon less than $30.10^{-4\%}$ sulfur less than $20.10^{-4\%}$
nitrogen less than $20.10^{-4\%}$ oxygen less than $20.10^{-4\%}$ phosphorus less than $50.10^{-4\%}$
the remainder being iron, and in that the strip steel resulting from hot-rolling, subjected to two cold-rollings separated by an intermediate annealing and followed by a final annealing, the degree of reduction of the final cold-rolling being between 50 and 80%, preferably between 60 and 75%, has a structure of the cubic type, at least 40% of the grains not deviating by more than 15° from the ideal cubic orientation (100) [001] in the Miller notation.

According to other characteristics, the sum of the percentages of silicon and aluminium is less than 9% in concentration by weight,
the silicon content is preferably less than 2.5% in concentration by weight,
the aluminium content is preferably between 1.5 and 5% in concentration by weight,
the intermediate annealing is carried out continuously at a temperature higher than 950° C. for 1 to 5 minutes,
the final annealing is carried out continuously at a temperature of between 950° and 1100° C. for 1 to 5 minutes,
the final annealing is carried out statically at a temperature of between 1000° and 1100° C. for 1 to 5 hours.

The magnetic sheet metal according to the invention containing, in particular, iron, silicon and aluminium is characterized in that the cubic structure shows magnetocrystalline anisotropic characteristics which, measured by the torsion balance method, have values greater than 8000 and 5600 J/m³ for the large maximum ($M_1$) and the small maximum ($m_2$) and a value greater than 0.70 for the anisotropy coefficient $$\rho = \frac{m_2}{M_1}.$$

The magnetic sheet metal according to the invention is further characterized in that the directions of easy magnetization are the direction of rolling and the direction perpendicular to rolling in the plane of the sheet metal.

BRIEF DESCRIPTION OF THE DRAWINGS

The tests described below with regard to the appended drawings determine the characteristics of the magnetic sheet metal according to the invention.

FIG. 2 represents the change in the losses at 1T-50 Hz as a function of the temperature of the final annealing for the thickness of 0.35 mm.

FIG. 3 represents the change in the losses at 1.5 T-50 Hz as a function of the temperature of the final annealing for the thickness of 0.35 mm.

Figure 1:
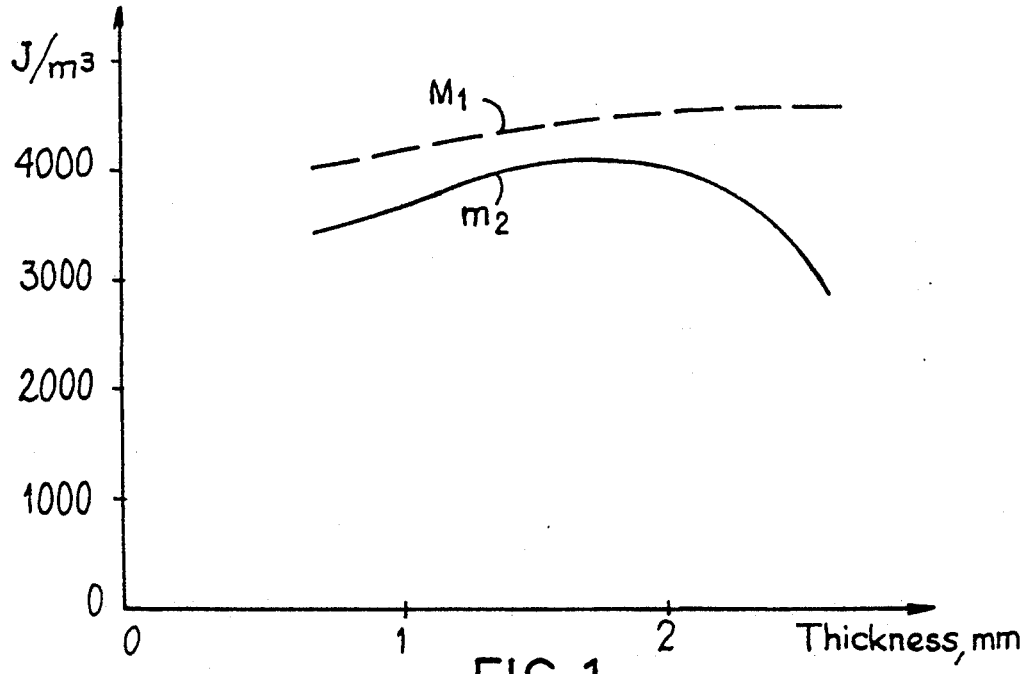
FIG. 1 represents the change in the maxima $m_2$, $M_1$ of the anisotropy torque measured at the intermediate thickness after a first cold-rolling and one annealing, as a function of the intermediate thickness.

The various steps in the production cycle have more or less pronounced influences on the characteristics of the sheet metal obtained, in particular the structure, the losses, the induction and that which will be described with the aid of several examples.

Tests were carried out to examine the influence of the initial solidification structure of the base steel ingot on the final structure of the sheet metal.

Two shapes of ingot mould were used, one of parallelepiped shape and the other of cylindrical shape.

These shapes simulate the phenomena which can be produced in the course of a solidification, one in continuous casting and the other by the ingot route.

An analysis of the structures by the technique of corrosion figures shows that the two ingots do not have a particularly pronounced solidification structure. The sheet metals obtained starting from the two ingots of different shapes have very close magnetic properties and grain sizes which are also similar, the initial shape of the ingot is of no significant consequence for the structure of the sheet metals which result therefrom after the heat treatment.

The base steel ingot is subjected to a hot-rolling to obtain a sheet steel having a thickness of about 2.5 mm. The cycle of treatment of the hot-rolled steel strip according to the invention is as follows:

cleaning,
1st cold-rolling to a thickness of 1 mm,
continuous intermediate annealing at 1020° C. for 2 min,
2nd cold-rolling to a thickness of 0.35 mm,
static final annealing at 1050° C. for 3 hours.

The characteristics of the samples are measured:

a—by chemical analysis,
b—by optical measurement to determine the grain size,
c—by measurement of the magnetic losses, and
d—by measurement of the anisotropy torque.

The anisotropy is measured using a torsion balance. The principle of the measurement is as follows:

After locating the direction of rolling, a disc having a diameter of about 15 mm is cut from the sheet metal by punching. This disc is then placed on a horizontal support, which is mobile about a vertical shaft, and an external magnetic field saturates the sample in a direction which varies from the horizontal plane and is registered by the angle which the magnetization makes with the direction of rolling. In the presence of a volume anisotropy energy, the sample disc is subjected to a torque, which tends to align the magnetization of the disc in accordance with one of the preferred directions termed directions of easy magnetization.

The measurement consists in varying the angle which the magnetization makes with the direction of rolling and in recording the mechanical torque which has to be exerted on the disc to keep it in place.

The modulus of the torque as a function of the angle which the magnetization makes with the direction of rolling follows essentially a sinusoidal course, having two different successive maxima $M_1$ and $m_2$, where $M_1$ is the large maximum and $m_2$ the small maximum, the anisotrophy being characterized by the ratio $$\rho = \frac{m_2}{M_1}$$

which tends towards 1 in the case of an ideal anisotropy, while the quality of the cubic structure is the better the higher are $M_1$ and $m_2$.

The cycle of treatment of the hot-rolled strip steel comprises two cold-rollings and the determination of the influence of the degrees of reduction in the course of these rollings is important for the characterization of the development of the structure. The measurement of the anisotropy torque is a parameter which enables this development to be appraised.

After a first cold-rolling, the hot-rolled strip steel is reduced to an intermediate thickness varying from 0.7 mm to 2 mm.

The study of the magnetocrystalline anisotropy torque after the first intermediate annealing enables the direction or directions of easy magnetization to be recognized, and the changes in the anisotropy torque curve enable the changes in structure to be registered.

Table 1 shows the results of anisotropy torque measurements obtained on the strip, reduced to the indicated thickness, of a steel according to the invention of composition Si 1.92%, Al 1.86%.

TABLE I

| Intermediate thickness | Orientation of the directions of easy magnetization | $M_1$ (J/m³) | $m_2$ (J/m³) | $\rho = \frac{m_2}{M_1}$ |
|---|---|---|---|---|
| $e_1$ = 2 mm | 0°-90° | 4 600 | 3 000 | 0.65 |
| $e_2$ = 1.5 mm | 0°-90° | 4 400 | 4 100 | 0.93 |
| $e_3$ = 1.0 mm | 0°-90° | 4 000 | 3 600 | 0.90 |
| $e_4$ = 0.7 mm | 0°-90° | 4 000 | 3 400 | 0.85 |
| $e_5$ = 0.5 mm | 0°-90° | 2 000 | 1 400 | 0.7 |
| $e_6$ = 0.35 mm | 0°-90° | 2 000 | 1 000 | 0.5 |

These results show that for a first suitable degree of cold-rolling, some samples possess a structure having a cubic appearance, with two well-marked directions of easy magnetization which are respectively parallel and perpendicular to the direction of rolling.

The variations in $m_2$ and $M_1$, and the measured value of $\rho$ as a function of the intermediate thickness, plotted in FIG. 1, show that the structure is not very sensitive to the variation in the intermediate thickness between 0.7 and 1.5 mm but deteriorates outside these limits.

The final structure can be influenced by the intermediate annealing in the production cycle according to the invention, in particular by the atmosphere during this heat treatment.

The intermediate annealing at a thickness of 1 mm is carried out in a dry atmosphere of purified hydrogen and then varying the proportion of oxygen.

Table II summarizes the results obtained at the intermediate stage of 1 mm and at the final stage of 0.35 mm, for the small and large maxima, and also the corresponding anisotropy coefficients, the composition of the steel being Si 1.92%, Al 1.86%.

TABLE II

| | Intermediate stage, 1 mm | | | Final stage, 0.35 mm | | |
|---|---|---|---|---|---|---|
| | $M_1$ (J/m³) | $m_2$ (J/m³) | $\rho = \frac{m_2}{M_1}$ | $M_1$ (J/m³) | $m_2$ (J/m³) | $\rho = \frac{m_2}{M_1}$ |
| Intermediate annealing in a dry atmosphere Dew point < −20° C. | 6 300 | 4 500 | 0.71 | 9 100 | 8 200 | 0.90 |
| Intermediate annealing in a moist atmosphere Dew point = +35° C. | 7 200 | 4 600 | 0.64 | 6 000 | 4 500 | 0.75 |

As the values of $\rho$ are higher after the heat treatments in a dry atmosphere, it is deduced from this that the use of a moist atmosphere is less favourable than that of a dry atmosphere for obtaining a cubic structure.

The role of the final annealing is important since the annealing must repair the defects introduced by the second cold-rolling and, moreover, the sheet metal resulting from this final annealing is used directly. The characteristics after the final annealing are therefore, the definitive characteristics.

Two series of tests enabled the characteristics of sheet metal obtained after static final annealing to be studied, on the one hand as a function of the variation in the temperature used in the static final annealing and on the other hand as a function of the time for which the products are held at temperature.

The measurements of the anisotropy torque are indicated in Table III for the thickness of 0.35 mm, as a function of the temperature of the final annealing.

TABLE III

| Conditions of static final annealing | $M_1$ (J/m$^3$) | $m_2$ (J/m$^3$) | $\rho = \frac{m_2}{M_1}$ |
|---|---|---|---|
| 950°-1 h | 8 000 | 6 000 | 0.75 |
| 1000°-1 h | 8 600 | 6 400 | 0.74 |
| 1050°-1 h | 8 600 | 6 400 | 0.74 |
| 1100°-1 h | 9 000 | 6 500 | 0.72 |

The temperature of the heat treatment does not have a significant influence on the anisotropy curves; in contrast, the study of the magnetic losses measured, respectively, at two induction values of 1 tesla and of 1.5 tesla as plotted in FIGS. 2 and 3 show an adverse increase in the said magnetic losses above a final annealing temperature of 1050° C. and below 950° C.

Figure 4:
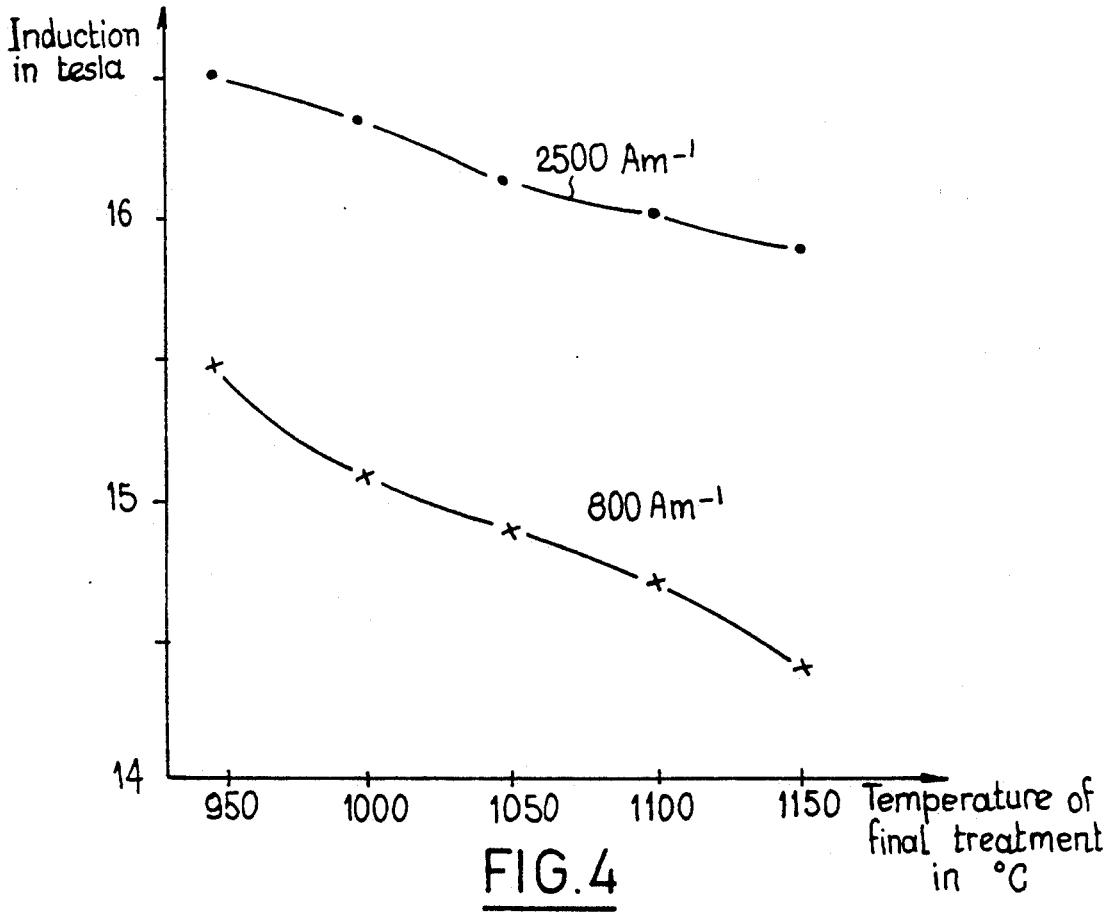
FIG. 4 represents the change in the inductions $B_{800}$ and $B_{2500}$ for the excitation fields of 800 A/m and 2500 A/m as a function of the temperature of the final treatment.

Likewise, the magnetization values as a function of the final annealing temperatures (for an annealing time of 1 hour) plotted in FIG. 4 show a decrease in the magnetization when the final annealing temperature increases.

The study of the magnetic losses and the magnetization enables a favourable temperature range for the final annealing to be determined, of between 1000° and 1100° C.

The anisotropy measurements as a function of the final annealing time at 1000° C. are grouped in Table IV below.

TABLE IV

| Static final annealing time | $M_1$ (J/m$^3$) | $m_2$ (J/m$^3$) | $\rho$ |
|---|---|---|---|
| 1 h | 8 500 | 6 400 | 0.75 |
| 2 h | 8 000 | 6 700 | 0.83 |
| 4 h | 8 600 | 6 400 | 0.74 |
| 8 h | 8 200 | 6 900 | 0.84 |
| 32 h | 8 100 | 6 200 | 0.76 |

The final annealing time does not influence the anisotropy value beyond a certain stage because the grains attain a size such that they traverse the sheet metal and that their growth stops. From the time this stage is reached, the structure no longer changes.

The intermediate annealing can be carried out continuously at a temperature higher than 950° C. for 1 to 5 min, and the final annealing at a temperature of between 950° and 1100° C., likewise for 1 to 5 min.

Amongst the impurities which are inevitably found in the alloys used to produce iron-silicon-aluminium magnetic sheets, the four elements sulphur, carbon, oxygen and nitrogen cause deteriorations at the level of the magnetic characteristics.

The following two examples show the influence of these elements on the anisotropy.

The treatment of sheet steels containing silicon and aluminium in the following proportions:

silicon less than 3.3%, preferably less than 2.5%, aluminium between 1.5 and 8%, preferably between 1.5 and 5%, as a concentration by weight such that the sum of the percentages of silicon and aluminium does not exceed 9% as a concentration by weight.

This treatment, comprising the following steps:

a hot-rolling
a cleaning
a first cold-rolling
an intermediate annealing
a second cold-rolling
a final annealing enables a sheet metal having a general structure of the cubic type to be obtained, at least 40% of the grains not deviating by more than 15° from the ideal cubic orientation (100) [001] in the Miller notation.

In Example 1, the composition of the steel is given in Table V.

TABLE V

| % by weight | | in ppm $10^{-4}$ % | | | | | | | |
|---|---|---|---|---|---|---|---|---|---|
| Si | Al | C | S | O | N | Mn | Cu | Co | Ni |
| 1.88 | 1.80 | 50 | 3 | 19 | 17 | 20 | 50 | 50 | 50 |

The samples are prepared starting from a hot-rolled steel sheet metal reduced to an intermediate thickness of 1 mm and then annealed under $H_2$ for 2 min at a temperature of 1020° C.

The characteristic values of the measurement of the anisotropy torque are then:

| | | |
|---|---|---|
| $M_1$ = 5000 J/m$^3$ | $m_2$ = 4300 J/m$^3$ | $\rho$ = 0.85 |

The anisotropy of the sheet metal is not very pronounced, but already has a cubic structure, the ratio of the maxima being $\rho=0.85$.

A cold-rolling is then carried out to obtain samples 0.35 mm thick, which are subjected to an annealing under $H_2$ for 3 hours at 1050° C.

The sheet metal obtained can be characterized by the following results:

losses at 1 tesla—50 Hz=0.80 w/kg
losses at 1.5 tesla—50 Hz=2.00 w/kg
induction for a continuous field
of 800 A/m: 1.50 T
of 2500 A/m: 1.63 T
$M_1$=9000 J/m$^3$
$m_2$=6800 J/m$^3$
$\rho$=0.76

The material obtained in the final stage is highly anisotropic. It has a pronounced structure, likewise of cubic appearance ($\rho=0.76$). It should be mentioned, in this case, that the structure obtained is equivalent to a mixture containing 46% of a pure (100) [001] structure, the remainder of the material being perfectly isotropic. Whether at the intermediate stage or at the final stage are the direction of rolling and the direction perpendicular to the direction of rolling can be regarded as the directions of easy magnetization.

In Example 2, the composition of the steel is given by Table VI below:

TABLE VI

| % by weight | | $10^{-4}$ % | | | | | | | | |
|---|---|---|---|---|---|---|---|---|---|---|
| Si | Al | C | S | O | N | Mn | Cu | Co | Ni | Cr |
| 1.86 | 1.81 | 40 | 2 | 11 | 1 | 50 | 50 | 60 | 30 | 20 |

The operating method to obtain samples remains identical to that described in Example 1.

The characteristic values of the anisotropy torque and the magnetic losses are, in this case:

| | | |
|---|---|---|
| $M_1 = 10200\ J/m^3$ | $m_2 = 8300\ J/m^3$ | $\rho = 0.81$ |
| losses at 1 tesla - 50 Hz = 0.76 w/kg | | |
| losses at 1.5 tesla - 50 Hz = 1.74 w/kg | | |
| $B_{800} = 1.52$ T | $B_{2500} = 1.64$ T | |

In this second example we obtained a higher percentage of cubic structure than in Example 1 and we are able to point out that both the loss characteristics and the magnetization characteristics are improved.

The present invention provides an improvement in the magnetic properties relative to the existing non-orientated iron-silicon sheet metals, while having mechanical properties comparable to those of the currently used non-orientated iron-silicon sheet metals.

We claim:

1. Magnetic sheet metal obtained from hot-rolled strip steel containing iron, silicon and aluminum, wherein its composition by weight is as follows:
   - silicon less than 3.3%,
   - aluminum between 1.5 and 8%,
   - manganese less than 0.2%,
   - sum of metal residues (nickel, chromium, molybdenum, titanium and copper) less than 0.1%,
   - carbon less than 30 ppm, sulphur less than 20 ppm, nitrogen less than 20 ppm,
   - oxygen less than 20 ppm and phosphorus less than 50 ppm,
   - the remainder being iron, the sum of percentages of silicon and aluminum being higher than 2.5% and up to 9% in concentration by weight, and wherein the strip steel is 2.5 mm thick resulting from having been hot-rolled, subjected to two cold-rollings in one or several passes, separated by an intermediate annealing carried out continuously at a temperature higher than 950° C. and followed by a final annealing, the degree of reduction of the first cold-rolling being between 50% and 75%, the degree of reduction of the second cold-rolling being between 60% and 75%, has a cubic structure at least 40% of the grains therein not deviating by more than 15° from the ideal cubic orientation (100) (001) in the Miller notation.

2. Magnetic sheet metal according to claim 1, wherein the silicon content is less than 2.5% in concentration by weight.

3. Magnetic sheet metal according to claim 1, wherein the aluminum content is between 1.5% and 5% in concentration by weight.

4. Magnetic sheet metal according to claim 3, wherein the final annealing has been carried out continuously at a temperature of between 950° C. and 1100° C. for 1 to 5 minutes.

5. Magnetic sheet metal according to claim 1, wherein the intermediate annealing has been carried out for 1 to 5 minutes.

6. Magnetic sheet metal according to claim 1, wherein the final annealing is static and has been carried out at a temperature of between 1000° and 1100° C. for 1 to 5 hours.

7. Magnetic sheet metal according to claim 1, wherein the cubic structure shows magnetocrystalline anisotropic characteristics which, measured by the torsion balance method described herein, have values greater than 8000 and 5600 $J/m^3$ for the large maximum ($M_1$) and the small maximum ($m_2$) and a value greater than 0.70 for the anisotropy coefficient $$\rho = \frac{m_2}{M_1}$$

8. Magnetic sheet metal according to claim 1, wherein the directions of easy magnetization are the direction of rolling and the direction perpendicular to rolling in the plane of the sheet metal.

* * * * *